US006013420A

United States Patent [19]

Wingender et al.

[11] Patent Number: 6,013,420

[45] Date of Patent: Jan. 11, 2000

[54] CHROMOGENIC PROCESS FOR THE PRODUCTION OF COLOR IMAGES USING A COLOR PHOTOGRAPHIC RECORDING MATERIAL, WHICH CONTAINS EMBEDDED COLOR DEVELOPER COMPOUNDS THAT CAN BE ACTIVATED BY HEAT TREATMENT

[75] Inventors: Kaspar Wingender, Leverkusen; Günther Schenk, Bergisch Gladbach, both of Germany

[73] Assignee: Agfa-Gevaert AG, Leverkusen, Germany

[21] Appl. No.: 09/092,168

[22] Filed: Jun. 5, 1998

[30] Foreign Application Priority Data

Jun. 13, 1997 [DE] Germany ..... 197 25 016

[51] Int. Cl.[7] ..... G03C 5/00

[52] U.S. Cl. ..... 430/350; 430/351; 430/376; 430/405

[58] Field of Search ..... 430/405, 415, 430/349, 441, 350, 448, 351, 376

[56] References Cited

U.S. PATENT DOCUMENTS

| | | | |
|---|---|---|---|
| 4,374,922 | 2/1983 | Ohbayashi et al. | 430/383 |
| 4,868,089 | 9/1989 | Kobayashi et al. | 430/203 |
| 5,582,953 | 12/1996 | Uyttendaele et al. | 430/203 |

FOREIGN PATENT DOCUMENTS

| | | |
|---|---|---|
| 459 210 | 4/1987 | European Pat. Off. . |
| 293 770 | 3/1991 | European Pat. Off. . |

OTHER PUBLICATIONS

The Theory of the Photographic Process, Fourth Edition, T.H. James, 1977.

*Primary Examiner*—Thorl Chea
*Attorney, Agent, or Firm*—Connolly Bove Lodge & Hutz

[57] ABSTRACT

A chromogenic process for the production of color images using, a color photographic recording material with at least one light-sensitive silver halide emulsion layer to which are assigned a thermosolvent, a color coupler and a color developer compound, and optionally further non light-sensitive layers, by exposure and development in an aqueous alkaline treatment bath (activator bath), characterised by the following features (a) and (b):

(a) the color developer compound is assigned to the silver halide emulsion layer in the form of an inactive precursor compound corresponding to formula I (capped color developer compound):

(I)

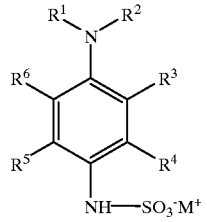

wherein:

$R^1$ and $R^2$ (the same or different) mean alkyl with up to 6 carbon atoms;

$R^3$, $R^4$, $R^5$ and $R^6$ (independently of one another) mean H, halogen, —OH, alkyl, alkoxy, acylamino or sulphonamido;

$M^+$ means an alkali metal ion, $NH_4^+$, a cation derived from a nitrogen-containing organic base, or a compound with a quaternary ammonium group, (b) the recording material undergoes a heat treatment prior to development in order to convert the capped color developer compound to an active form capable of color coupling.

4 Claims, No Drawings

CHROMOGENIC PROCESS FOR THE PRODUCTION OF COLOR IMAGES USING A COLOR PHOTOGRAPHIC RECORDING MATERIAL, WHICH CONTAINS EMBEDDED COLOR DEVELOPER COMPOUNDS THAT CAN BE ACTIVATED BY HEAT TREATMENT

The invention relates to a chromogenic process for the production of color images using a color photographic recording material which contains a color coupler and a capped color developer compound assigned to at least one light-sensitive silver halide emulsion layer, wherein the recording material undergoes a heat treatment prior to development in order to convert the capped color developer compound to an active form capable of color coupling.

In conventional chromogenic development, an exposed color photographic recording material which contains at least one color coupler assigned to a silver halide emulsion layer is treated with an aqueous alkaline bath in the presence of a color developer compound. The color developer compound is normally contained in an alkaline treatment bath; it may also, however, be contained in a layer of the color photographic recording material, though stability problems frequently occur.

Heat-developable recording materials are known which may be developed to an image rapidly and in the dry state by means of a heat treatment, as described, for example, in EP-A-0 293 770, page 2, lines 10–34. If color photographic materials are involved, the expensive components of dye diffusion chemistry are a disadvantage.

The use of color developer precursors (CDP) is also known; when corresponding recording materials are processed, the developers are activated by treatment in a mostly alkaline activator bath of the kind described, for example, in EP-A-0 459 210.

A disadvantage in this case is that either the pH values (pH>12) required are so high that coupling does not take place properly, or that the CDP is so unstable that the unprocessed material is not sufficiently stable in storage.

The object of the invention is to provide a simplified chromogenic image production process in which, using a color photographic recording material with conventional coupler chemistry, high-quality dye images are obtained by treatment with an alkaline activator bath without the above-mentioned stability problems occurring.

It was found that a color photographic recording material with conventional coupler chemistry and certain embedded CDP compounds may undergo a dry heat treatment wherein the capped developer compounds are activated, i.e. are converted to their active form, so that development may take place during a subsequent treatment with an aqueous alkaline activator bath. The heat treatment usually takes place after exposure; it may also, however, take place wholly or partially prior to exposure.

The invention provides a chromogenic process for the production of color images using a color photographic recording material with at least one light-sensitive silver halide emulsion layer to which are assigned a thermosolvent, a color coupler and a color developer compound, and optionally further non light-sensitive layers, by exposure and development in an aqueous alkaline treatment bath (activator bath), characterised by the following features (a) and (b):

(a) the color developer compound is assigned to the silver halide emulsion layer in the form of an inactive precursor compound corresponding to formula I (capped color developer compound):

(I)

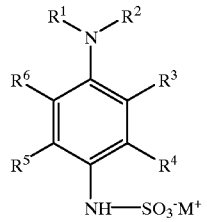

wherein:

$R^1$ and $R^2$ (the same or different) mean alkyl with up to 6 carbon atoms, optionally substituted, e.g. with —OH, alkoxy or alkylsulphonamido;

$R^3$, $R^4$, $R^5$ and $R^6$ (independently of one another) mean H, halogen, —OH, alkyl, alkoxy, acylamino or sulphonamido;

$M^+$ means an alkali metal ion, $NH_4^+$, a cation derived from a nitrogen-containing organic base, or a compound with a quaternary ammonium group.

(b) the recording material undergoes a heat treatment prior to development in order to convert the capped color developer compound to an active form capable of color coupling.

The invention also relates to a recording material suitable for carrying out the process according to the invention, namely a color photographic recording material with at least one light-sensitive silver halide emulsion layer to which are assigned a thermosolvent, a color coupler and a color developer compound, and optionally further non light-sensitive layers, which recording material contains, assigned to a light-sensitive silver halide emulsion layer and a color coupler, at least one compound corresponding to formula I (capped color developer compound). The capped color developer compound is assigned to the light-sensitive silver halide emulsion layer and the color coupler in such a way that, under the development conditions, electron transfer is able to take place between the exposed silver halide and the activated color developer compound, and the color developer oxidation product thus produced is able to react with the color coupler. To this end, silver halide and (capped) color developer compound need not necessarily be present in the same layer. In multilayer color photographic materials, the capped color developer compound and the thermosolvent may also be contained in a single layer which need not necessarily be immediately adjacent to one of the silver halide emulsion layers, provided the uncapped color developer compound can diffuse into each of the existing silver halide emulsion layers under the development conditions. Thermo-solvent and capped color developer compound should be contained in the same layer or in adjacent layers.

The invention includes all color photographic materials and processes with chromogenic development, in so far as embedded capped color developers are used for this purpose, if the capped color developers are activated by a heat treatment and are introduced into a subsequent aqueous alkaline treatment bath (activator bath) with the color couplers for chromogenic coupling. Said materials may be monochrome or multi-colored color photographic materials or black/white materials. These materials also include those which are processed by a so-called color intensification process of the kind described, e.g. in Research Disclosure 34848 (April 1993).

Examples of color photographic materials are color negative films, color reversal films, color positive films, color photographic paper, color reversal photographic paper. A review of typical color photographic materials and preferred forms of embodiment and processing processes can be found in Research Disclosure 37038 (February 1995).

The photographic materials are composed of a support to which is applied at least one light-sensitive silver halide emulsion layer. Suitable supports are, in particular, thin films and sheets. A review of support materials and of auxiliary layers applied to the front and back thereof is given in Research Disclosure 37254, part 1 (1995), page 285. The support materials considered in the present case must, however, be able to withstand the high temperatures required for the activation of the color developer compound without damage.

The color photographic materials usually contain at least one red-sensitive, one green-sensitive and one blue-sensitive silver halide emulsion layer and optionally intermediate layers and protective layers.

Depending on the type of photographic material, these layers may be arranged in different ways. This will be demonstrated for the most important products:

Color photographic films such as color negative films and color reversal films have on the support, in the sequence given below, 2 or 3 red-sensitive, cyan-coupling silver halide emulsion layers, 2 or 3 green-sensitive, magenta-coupling silver halide emulsion layers, and 2 or 3 blue-sensitive, yellow-coupling silver halide emulsion layers. The layers with the same spectral sensitivity differ in terms of their photographic sensitivity, the less sensitive partial layers usually being arranged closer to the support than the more sensitive partial layers.

Between the green-sensitive and blue-sensitive layers there may be arranged a yellow filter layer which prevents blue light from reaching the underlying layers.

The possibilities of the various layer arrangements and their effects on the photographic properties are described in J. Inf Rec. Mats., 1994, Vol. 22, pages 183–193.

Color photographic paper, which is usually substantially less light-sensitive than a color photographic film, usually has on the support, in the sequence given below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be absent.

Deviations from the number and arrangement of light-sensitive layers may be made in order to achieve certain results. For example, all the highly sensitive layers may be grouped together to form a packet of layers and all the low-sensitivity layers may be grouped together to form another packet of layers in a photographic film in order to increase the sensitivity (DE-A-25 30 645).

Important constituents of the photographic emulsion layers are binders, silver halide grains, color couplers and, in the present case, capped color developers and thermosolvents.

Details about suitable binders may be found in Research Disclosure 37254, part 2 (1995), page 286.

Details about suitable silver halide emulsions, their preparation, ripening, stabilization and spectral sensitization including suitable spectral sensitizers may be found in Research Disclosure 36544 (Sept. 1994) and Research Disclosure 37254, part 3 (1995), page 286 and in Research Disclosure 37038, part XV (1995), page 89.

Photographic materials with camera sensitivity usually contain silver bromide iodide emulsions which may optionally also contain small proportions of silver chloride. Photographic copier materials contain either silver chloride bromide emulsions with up to 80 mol- % of AgBr or silver chloride bromide emulsions with more than 95 mol- % of AgCI. In order to improve the storage stability and development fog, the heat-activated material of the invention may also contain organic silver salts, e.g. of benztriazole or benztriazole derivatives or of long-chain aliphatic carboxylic acids, such as behenic acid. In the present case, it has proved advantageous if the light-sensitive silver halide emulsion layers, based on the quantity of the assigned color coupler, contain silver halide in 0.5 to 5 times the equivalent quantity and organic silver salt in less than 0.1 times the equivalent quantity, or contain no organic silver salt.

Details about the color couplers may be found in Research Disclosure 37254, part 4 (1995), page 288 and in Research Disclosure 37038, part II (1995), page 80. The maximum absorption of the dyes formed from the couplers and the color developer oxidation product is preferably in the following ranges: yellow coupler 430 to 460 nm, magenta coupler 540 to 560 nm, cyan coupler 630 to 700 nm.

In order to improve sensitivity, granularity, sharpness and color separation in color photographic films, compounds are frequently used which, during the reaction with the developer oxidation product, release compounds which are photographically effective, e.g. DIR couplers which cleave a development inhibitor. Details about such compounds, particularly couplers, may be found in Research Disclosure 37254, part 5 (1995), page 290 and in Research Disclosure 3703, part XIV (1995), page 86.

Most hydrophobic color couplers, but also other hydrophobic constituents of the layers, are usually dissolved or dispersed in high-boiling organic solvents. Said solutions or dispersions are then emulsified in an aqueous binder solution (usually gyelatin solution) and after the layers have dried are present as fine droplets (0.05 to 0.8 mm in diameter) in the layers.

Suitable high-boiling organic solvents, methods of introduction into the layers of a photographic material and further methods of introducing chemical compounds into photographic layers may be found in Research Disclosure 37254, Part 6 (1995), page 292.

Further constituents of the material used in the process according to the invention are so-called thermosolvents, by which is generally meant non hydrolyzable organic compounds which are solid under normal conditions but melt on heating to the temperature of the heat treatment and in so doing provide a liquid medium in which the development processes are able to take place more quickly. Such thermosolvents may act, for example, as diffusion accelerators. Preferred examples of the thermosolvents include polyglycols of the kind described, for example, in U.S. Pat. No. 3 347 675, e.g. polyethylene glycol with an average molecular weight of 1,500 to 20,000, derivatives of polyethylene oxide, such as, for example, the oleic acid esters thereof, beeswax, monostearin, compounds with a high dielectric constant containing an —$SO_2$ or —CO group, such as, e.g. acetamide, succinamide, ethyl carbamate, urea and urea derivatives, methylsulphonamide, ethylene carbonate, also polar substances of the kind described in U.S. Pat. No. 3,667,959, the lactone of 4-hydroxybutyric acid, dimethylsulphoxide, tetrahydrothiophene-1,1-dioxide and 1,10-decane diol, methyl anisate, biphenyl suberate. Particularly suitable thermosolvents are also described in EP-A-0 293 770, for example, urea derivatives are mentioned therein such as dimethylurea, diethylurea, phenylurea, amide derivatives such as acetamide, benzamide, p-toluamide, p-butoxybenzamide; sulphonamide derivatives such as benzene sulphonamide, α-toluene sulphonamide; polyhydric alcohols such as 1,5-pentanediol, 1,6-hexanediol, 1,2-cyclohexanediol, pentaerythritol, trimethylol ethane; and polyethylene glycols.

Further possible auxiliaries are, for example, basic substances or compounds which are able to supply basic substances under the action of the heat treatment (base donors). Substances to be mentioned here by way of example are sodium hydroxide, potassium hydroxide, calcium hydroxide, sodium carbonate, sodium acetate, and organic bases, particularly amines such as trialkylamines, hydroxyalkylamines, piperidine, morpholine, dialkylaniline, p-toluidine, 2-picoline, guanidine and the salts thereof, particularly salts with aliphatic carboxylic acids. As a result of the provision of the basic substances, a suitable medium is created in the light-sensitive layer and the adjacent layers during the heat treatment in order to guarantee the activation of the color developer compounds or their release from the corresponding precursor compounds (compounds having formula I). If bases or base donors are used, the treatment bath may be purely aqueous; the development stage may also, however, take place "semi-dry", i.e. for example, a maximum of only as much water is applied in layer form as the layer structure of the color photographic recording material is able to absorb by way of the swelling of the layers.

Further auxiliaries are, for example, compounds which are able to release water under the action of heat. Inorganic salts containing water of crystallisation in particular are suitable, e.g. $Na_2SO_4 \cdot 10\ H_2O$, $NH_4Fe(SO_4)_2 \cdot 12\ H_2O$. The water released during heating promotes the development and diffusion processes required to produce an image.

The non light-sensitive intermediate layers usually arranged between layers of differing spectral sensitivity may contain agents which prevent unwanted diffusion of developer oxidation products from one light-sensitive to another light-sensitive layer with a different spectral sensitization.

Suitable compounds (white couplers, scavengers or DOP scavengers) may be found in Research Disclosure 37254, Part 7 (1995), page 292 and in Research Disclosure 37038, Part III (1995), page 84.

The photographic material may also contain UV light-absorbing compounds, fluorescent brighteners, spacers, filter dyes, formalin scavengers, light stabilizers, antioxidants, $D_{min}$ dyes, additives to improve the dye stability, coupler stability and white stability and to reduce fog, plasticizers (lattices), biocides and others.

Suitable compounds may be found in Research Disclosure 37254, part 8 (1995), page 292 and in Research Disclosure 37038, parts IV, V, VI, VII, X, XI and XIII (1995), pages 84 ff.

The layers of color photographic materials are usually hardened, i.e., the binder used, preferably gelatin, is cross-linked by suitable chemical processes.

Suitable hardener substances may be found in Research Disclosure 37254, part 9 (1995), page 294 and in Research Disclosure 37038, part XII (1995), page 86.

After exposure, color photographic materials are processed by various methods according to their character. Details about methods of operating and the chemicals required are published together with materials given by way of example in Research Disclosure 37254, part 10 (1995), page 294 and in Research Disclosure 37038, parts XVI to XXIII (1995), page 95 ff. In the process according to the invention, however, the developer baths need not contain any developer substances (activator).

The heat-activated material is developed in a treatment bath after exposure. The developer compound must be activated beforehand according to the invention. This may take place before, during or after exposure. The temperature range for activation may be between 80° C. and 200° C., preferably between 110° C. and 170° C. The duration of the treatment is between 1 s and 120 s, preferably between 2 s and 30 s.

Device suitable for heating:

Heat activation of the recording material according to the invention may be achieved in numerous ways, e.g. by bringing it into contact with a hot plate, roll or drum, by passing it through a channel of hot air, by means of high frequency heating or microwave heating. Heat activation may take place before, during or after exposure.

EXAMPLE 1

A color photographic recording material was produced by applying the following layers in the stated order to a layer support of baryta paper substrate. The quantity details are based on 1 $m^2$. The corresponding quantities of $AgNO_3$ are given for the silver halide application.

SAMPLES 1–4

| | |
|---|---|
| Layer 1: | (green-sensitive layer) |
| | green-sensitised silver halide emulsion (74 mol-% of bromide, 16 mol-% of chloride, average particle diameter 0.35 $\mu$m) of 0.38 g $AgNO_3$, with |
| | 1.05 g gelatin |
| | 0.40 g magenta coupler XM-1 |
| | 0.06 g 2,5-dioctylhydroquinone |
| | 0.46 g dibutyladipate (DBA) |
| | 0.40 g tricresylphosphate (TCP) |
| | 0.50 g 2,2-bishydroxymethyl-1-butanol |
| Layer 2: | (Layer with the Thermally Activated Color developer, TAC) |
| | 1.50 g gelatin |
| | 1.50 g TAC-1 |
| Layer 3: | (Hardening layer) |
| | 0.10 g gelatin |
| | 0.50 g hardener XH-1 |

Compounds used in Example 1:

XM-1

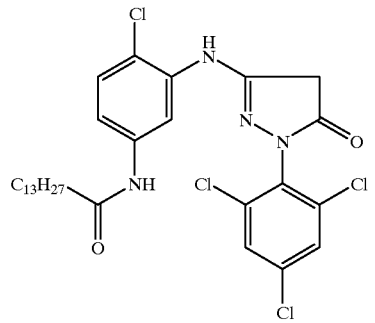

XH-1

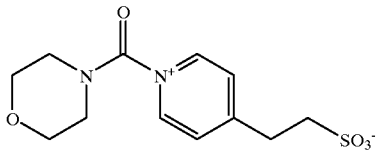

TAC compounds used in Examples 1–4:

TAC-1

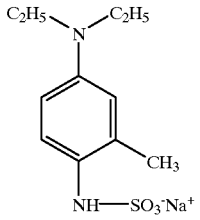

TAC-2

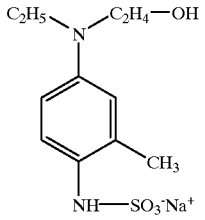

The layers were dried and exposed in a sensitometer through a stepped optical wedge with 120 1x.s behind a green filter. Various samples 1 to 4 of this material were treated with the following baths, as may be seen from Table 1:

1. Alkali bath 20.0 g $K_2CO_3$
980.0 g water pH 11.4

2. Bleach-fixing bath 800 g water
45 g ammonium-iron-III-EDTA
10 g sodium sulphite
80 g ammonium thiosulphate
make up to 1000 ml with water pH 6.0

The samples 1 to 4 were treated as follows (Table 1):

| | | |
|---|---|---|
| 1. | | Activation of the developer (heating) |
| 2. | | Activator bath (alkali bath) 23° C. |
| 3. | 25 s | Bleach-fixing 30° C. |
| 4. | 60 s | Washing 23° C. |

After drying, the maximum and minimum color densities were measured behind a green filter (Table 1).

TABLE 1

| Sample | 1 | 2 | 3 | 4 |
|---|---|---|---|---|
| Heating 140° C. | — | 10 s | — | 5 s |
| Exposure | x | x | x | x |
| Heating 140° C. | — | — | 10 s | 5 sec |
| Alkali bath | x | x | x | x |
| Bleach-fixing | x | x | x | x |
| $D_{max}$ | 0.08 | 2.20 | 2.20 | 2.20 |
| $D_{min}$ | 0.08 | 0.09 | 0.09 | 0.09 |

The result shows that no development takes place without thermal activation of the embedded capped developer. Activation may take place before and/or after exposure.

EXAMPLE 2

A further color photographic recording material (samples 5–8) was prepared by applying the following layers in the stated order to a layer support of baryta paper substrate.

Samples 5–8

Layer 1: (green-sensitive layer)
green-sensitised silver halide emulsion (100 mol-% of chloride, average particle diameter 0.38 μm) of 0.34 g $AgNO_3$, with
1.05 g gelatin
0.40 g magenta coupler XM-1
0.06 g 2,5-dioctylhydroquinone
0.46 g DBP
0.40 g TCP
0.50 g 2,2-bishydroxymethyl-1-butanol
1.50 g TAC-1
Layer 2: (hardening layer)
0.50 g gelatin
0.10 g hardener XH-1

The layers were dried and exposed and processed as in Example 1. The color densities measured behind a green filter show that development is dependent on the thermal pretreatment of the samples (Table 2).

TABLE 2

| Sample | 5 | 6 | 7 | 8 |
|---|---|---|---|---|
| Heating | 160° C. | 140° C. | 100° C. | none |
| $D_{min}$ | 0.13 | 0.10 | 0.09 | 0.08 |
| $D_{max}$ | 2.25 | 2.30 | 0.60 | 0.08 |

EXAMPLE 3

Further color photographic recording materials were prepared (samples 9 and 10) by applying the following layers in the stated order to a layer support of baryta paper substrate.

Sample 9 (red-sensitive)

Layer 1: (red-sensitive layer)
red-sensitised silver halide emulsion (100 mol-% of chloride, average particle diameter 0.30 μm) of 0.34 g $AgNO_3$, with
0.72 g gelatin
0.36 g cyan coupler XC-1
0.36 g TCP
0.50 g sorbitol
Layer 2: (layer with the Thermally Activated Color developer TAC)
1.50 g gelatin
1.50 g TAC-1
Layer 3: (hardening layer)
0.50 g gelatin
0.10 g hardener XH-1

After drying, sample 9 was processed like sample 3 in Example 1 and measured behind a red filter (Table 3).

Sample 10 (blue-sensitive)

Layer 1: (blue-sensitive layer)
blue-sensitised silver halide emulsion (1 mol-% of bromide, 99 mol-% of chloride, average particle diameter 0.80 μm) of 0.40 g $AgNO_3$, with
1.04 g gelatin
0.60 g yellow coupler XY-1
0.01 g white coupler XW-1
0.60 g TCP
0.70 g sorbitol
Layer 2: (layer with the Thermally Activated Color developer TAC)
1.50 g gelatin
1.50 g TAC-1

-continued

Layer 3: (hardening layer)
0.50 g gelatin
0.10 g hardener XH-1

After drying, sample 10 was processed like sample 3 in Example 1 and measured behind a blue filter (Table 3).

Compounds used in Example 3:

XC-1

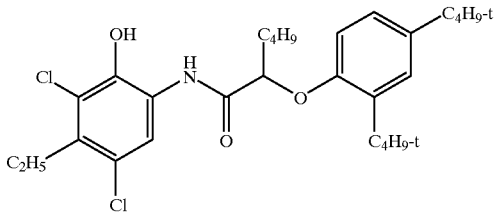

XY-1

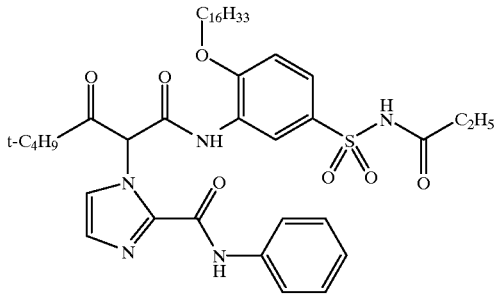

XW-1

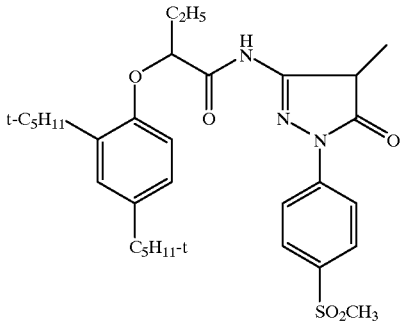

TABLE 3

| Sample | 9 | 10 |
|---|---|---|
| Heating 140° C. | 10 s | 10 s |
| $D_{min}$ | 0.08 | 0.11 |
| $D_{max}$ | 2.35 | 2.15 |

EXAMPLE 4

The following layers were applied in the stated order to a baryta paper substrate (samples 11–13).

Samples 11–13

Layer 1: 0.80 g gelatin

-continued 0.65 g 2,2-bishydroxymethyl-1-butanol
Layer 2: (green-sensitive layer)
green-sensitised silver halide emulsion (100 mol-% of chloride, average particle diameter 0.30 μm), of 0.03 g $AgNO_3$, with
0.85 g gelatin
0.40 g magenta coupler XM-1
0.06 g 2,5-dioctylhydroquinone
0.46 g DBP
0.40 g TCP
1.65 g TAC-2
Layer 3: (hardening layer)
0.50 g gelatin
0.10 g hardener XH-1

After the layers had been dried, they were exposed in a sensitometer behind a green filter. Samples 11–13 were processed in the following baths:

1. Alkali bath 20.0 g $Na_2CO_3$
980.0 g water
pH 11.2

2. Intensification bath 10 ml $H_2O_2$ (35 wt. %)
990 ml dist. water

3. Fixing bath 50.0 g ammonium thiosulphate
5.0 g sodium sulphite
2.0 g sodium hydrogen sulphite
make up to 1000.0 ml with water
pH 10.6

With or without thermal activation, the samples were initially treated in an alkali bath and subsequently treated with/without an intensification bath.

Table 4 shows again that the blocked developer is activated by adding heat. It is also proved that despite the substantially reduced silver application, intensification of the dye image takes place by means of an after-treatment in an oxidation bath. A silver bleach may be omitted.

TABLE 4

| Sample | 11 | 12 | 13 |
|---|---|---|---|
| Heating 140° C. | — | 10 s | 10 s |
| Alkali bath | 15 s | 15 s | 15 s |
| Intensification bath | 10 s | — | 10 s |
| Washing | 15 s | 15 s | 15 s |
| $D_{max}$ | 0.09 | 0.50 | 1.95 |
| $D_{min}$ | 0.09 | 0.09 | 0.10 |

We claim:

1. A chromogenic process for the production of color images which comprises exposing imagewise a color photographic material to light and developing said color photographic material in an aqueous alkaline treatment batch (activator bath) wherein said color photographic recording material comprising at least one light-sensitive silver halide emulsion layer having a thermosolvent and a color coupler and at least one non light-sensitive layer wherein the light-sensitive silver halide emulsion layer or the non light-sensitive layer contains a color developer compound in the form of an inactive precursor compound corresponding to formula I (capped color developer compound):

(I)

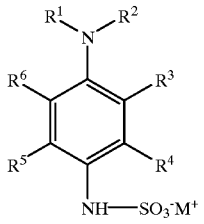

wherein $R^1$ and $R^2$ (the same or different) and are an alkyl with up to 6 carbon atoms;

$R^3$, $R^4$, $R^5$ and $R^5$ (independently of one another) and are H, halogen, —OH, alkyl, alkoxy, acylamino or sulphonamido;

$M^+$ is an alkali metal ion, $NH_4^+$, a cation derived from a nitrogen-containing organic base, or a compound with a quaternary ammonium group;

said process comprises a heat treatment prior to development in order to convert the capped color developer compound to an active form capable of color coupling.

2. A process according to claim 1, wherein said photographic recording material contains the capped color developer compound in a light-sensitive silver halide emulsion layer.

3. A process according to claim 2, wherein said capped developer compound contains a ballast group with 8–16 carbon atoms.

4. A process according to claim 1, wherein said color photographic recording material contains the capped color developer compound in a non light-sensitive layer.

* * * * *